US011594207B2

(12) United States Patent
Burrowes et al.

(10) Patent No.: US 11,594,207 B2
(45) Date of Patent: Feb. 28, 2023

(54) TECHNIQUES FOR DIGITALLY RENDERING AUDIO WAVEFORMS AND RELATED SYSTEMS AND METHODS

(71) Applicant: Harmonix Music Systems, Inc., Boston, MA (US)

(72) Inventors: Paul Burrowes, Woburn, MA (US); Michael Burrowes, Woburn, MA (US)

(73) Assignee: Harmonix Music Systems, Inc., Boston, MA (US)

( * ) Notice: Subject to any disclaimer, the term of this patent is extended or adjusted under 35 U.S.C. 154(b) by 93 days.

(21) Appl. No.: 16/987,302

(22) Filed: Aug. 6, 2020

(65) Prior Publication Data

US 2021/0043180 A1 Feb. 11, 2021

Related U.S. Application Data

(60) Provisional application No. 62/884,424, filed on Aug. 8, 2019.

(51) Int. Cl.
*G10H 7/02* (2006.01)
*G10H 1/00* (2006.01)

(52) U.S. Cl.
CPC ..... *G10H 7/02* (2013.01); *G10H 1/0008* (2013.01)

(58) Field of Classification Search
CPC ..... G10H 7/02; G10H 1/0008
USPC ..... 84/603
See application file for complete search history.

(56) References Cited

U.S. PATENT DOCUMENTS 4,416,180 A * 11/1983 Ichigaya ..... G10H 1/08 84/625
5,831,193 A * 11/1998 Suzuki ..... G10H 7/02 84/625
6,365,817 B1 * 4/2002 Suzuki ..... G10H 7/02 84/629
6,486,389 B1 * 11/2002 Suzuki ..... G10H 1/02 84/629
7,003,120 B1 * 2/2006 Smith ..... G10H 1/383 381/103

(Continued)

FOREIGN PATENT DOCUMENTS

JP H07-92978 A 4/1995
JP H0792978 A * 4/1995

(Continued)

OTHER PUBLICATIONS

Horner et al.: "Methods for Multiple Wavetable Synthesis of Musical Instruments Tones",May 1993, Journal of the Audio Engineering Society, vol. 41, No. 5, pp. 336-355 (Year: 1993).*

(Continued)

*Primary Examiner* — Christina M Schreiber
(74) *Attorney, Agent, or Firm* — Wolf, Greenfield & Sacks, P.C.

(57) ABSTRACT

Described herein are techniques for synthesizing waves (e.g., audio waveforms) at various frequencies. For example, techniques described herein may be used to render musical notes by generating audio waveforms. According to some embodiments, the techniques generate a wave table for an audio waveform based on a set of partial waveforms. The system determines a set of notes with a corresponding entry in the wave table and determines a set of partials for each note. The system renders, for each note, an associated waveform comprising the associated number of partials for the note from the set of partial waveforms.

20 Claims, 6 Drawing Sheets

(56) References Cited

U.S. PATENT DOCUMENTS

| | | | | |
|---|---|---|---|---|
| 2003/0154847 | A1* | 8/2003 | Akazawa | G10H 7/02 84/627 |
| 2006/0081119 | A1* | 4/2006 | Kuroda | G10H 1/0575 84/659 |
| 2007/0185719 | A1* | 8/2007 | Miyazaki | H04S 7/305 704/500 |
| 2015/0243291 | A1* | 8/2015 | Shirahama | G10L 13/02 704/500 |
| 2020/0111463 | A1* | 4/2020 | Sakata | G10H 5/007 |
| 2021/0043180 | A1* | 2/2021 | Burrowes | G10H 7/02 |
| 2021/0232358 | A1* | 7/2021 | Bethurum | G06F 3/165 |
| 2021/0312898 | A1* | 10/2021 | Squartini | G10H 7/12 |

FOREIGN PATENT DOCUMENTS

| | | | | |
|---|---|---|---|---|
| JP | 3644263 | B2 * | 4/2005 | G10H 1/02 |
| JP | 3714397 | B2 * | 11/2005 | |
| JP | 4226164 | B2 * | 2/2009 | |
| JP | 2013140298 | A * | 7/2013 | G10H 1/46 |

OTHER PUBLICATIONS

Lee et al.: "Modeling Piano Tones with Group Synthesis", Mar. 1999, Journal of the Audio Engineering Society, vol. 47, No. 3, pp. 101-111 (Year: 1999).*

Masri: "Computer Modelling of Sound for Transforamtion and Synthesis of Musical Signals", Thesis, Dec. 1996, http://www.mp3-tech.org/programmer/docs/Masri_thesis.pdf (Year: 1996).*

International Search Report and Written Opinion for International Application No. PCT/US2020/045260 dated Nov. 25, 2020.

Horner et al., Methods for multiple wavetable synthesis of musical instrument tones. Journal of the Audio Engineering Society. May 1, 1993;41(5):336-56.

Lee et al., Modeling piano tones with group synthesis. Journal of the Audio Engineering Society. Mar. 1, 1999;47(3):101-11.

Masri et al., Computer modelling of sound for transformation and synthesis of musical signals. University of Bristol Doctoral dissertation in the Department of Electrical and Electronic Engineering. Dec. 1996:240 pages.

* cited by examiner

TECHNIQUES FOR DIGITALLY RENDERING AUDIO WAVEFORMS AND RELATED SYSTEMS AND METHODS

CROSS-REFERENCE TO RELATED APPLICATIONS

This application claims the benefit of U.S. Provisional Patent Application No. 62/884,424, filed Aug. 8, 2019, which is incorporated by reference herein in its entirety.

BACKGROUND

Analog and/or digital synthesizers can be used to generate audio sounds. Analog synthesizers typically use analog circuitry (e.g., sound-generating circuitry and modulators) to generate sounds. A user can, for example, configure oscillators to generate various audio waveforms at different musical pitches. Digital synthesizers, in contrast, use digital processors. In the digital domain, a number of steps are often applied in order to store and reproduce an audio signal. For example, the techniques can include filtering (e.g., low pass filtering), performing an analog-to-digital conversion (e.g., including sampling the audio signal) to generate a digital waveform, and storing the waveform in an audio file. In order to change the pitch of a stored waveform, the waveform can be re-sampled at different rates to change the frequency of the signal.

SUMMARY

Described herein are techniques for authoring arbitrarily shaped waveforms (e.g., to generate music). In some embodiments, the techniques use a wave table that includes various forms of the waveform, where each form has a different number of partial waveforms (e.g., associated with a different pitch range). The techniques may determine a number of partials for the waveform and then generate the waveform from the wave table based on the determined number of partials. The generated waveform may then be generated in a context (e.g., producing a sound in a video game).

According to one aspect, a computer-implemented method of generating an audio waveform at a playback frequency is provided. The method comprises: obtaining first data indicative of a set of partial waveforms of the audio waveform; and generating a wave table for the audio waveform based on the set of partial waveforms, the generating comprising: determining a set of notes, wherein each note has a corresponding entry in the wave table; determining, for each note in the set of notes, an associated number of partials for the note; and rendering, for each note in the set of notes, an associated waveform comprising the determined associated number of partials for the note from the set of partial waveforms.

In one embodiment, the method further comprises: determining a number of partial waveforms based on a sample rate, a playback frequency of the audio waveform, or both; and selecting, based on the first data and the number of partial waveforms, at least one waveform version from a set of waveform versions associated with the audio waveform to generate the audio waveform at the playback frequency, wherein each waveform version in the set of waveform versions comprises an associated different number of partial waveforms for the audio waveform. According to one embodiment, selecting the at least one waveform version comprises: selecting a first waveform version for generating a first portion of the audio waveform; and selecting a second waveform version for generating a second portion of the audio waveform, the selecting comprising determining a start location of the second waveform based on an end location of the first waveform. According to one embodiment, the method further comprises resampling the selected at least one waveform version to generate the audio waveform at the playback frequency. According to one embodiment, determining the associated number of partial waveforms comprises determining a maximum number of partial waveforms for the playback frequency of the audio waveform.

According to one embodiment, obtaining the first data indicative of the set of partial waveforms comprises: sampling the audio waveform to generate a sampled waveform; transforming the sampled waveform from a time domain to a frequency domain to generate a frequency domain sampled waveform; and determining, based on the frequency domain sampled waveform, the set of partial waveforms for the audio waveform.

According to one embodiment, determining the associated number of partials for each note comprises: determining a supported sampling rate; and determining the associated number of partials for each note by dividing the supported sampling rate by a frequency of the associated note.

According to another aspect, a system for generating an audio waveform at a playback frequency is provided. The system comprises: a processor in communication with a memory, wherein the memory is configured to store machine readable instructions that, when executed by the processor, cause the processor to: obtain first data indicative of a set of partial waveforms of an audio waveform; and generate a wave table for the audio waveform based on the set of partial waveforms, comprising: determine a set of notes, wherein each note has a corresponding entry in the wave table; determine, for each note in the set of notes, an associated number of partials for the note; and render, for each note in the set of notes, an associated waveform comprising the determined associated number of partials for the note from the set of partial waveforms.

According to one embodiment, the instructions are further configured to cause the processor to: determine a number of partial waveforms based on a sample rate, a playback frequency of the audio waveform, or both; and select, based on the first data and the number of partial waveforms, at least one waveform version from a set of waveform versions associated with the audio waveform to generate the audio waveform at the playback frequency, wherein each waveform version in the set of waveform versions comprises an associated different number of partial waveforms for the audio waveform. According to one embodiment, selecting the at least one waveform version comprises: selecting a first waveform version for generating a first portion of the audio waveform; and selecting a second waveform version for generating a second portion of the new audio waveform, wherein the selecting comprises determining a start location of the second waveform based on an end location of the first waveform. According to one embodiment, the instructions are further configured to cause the processor to resample the selected at least one waveform version to generate the audio waveform at the playback frequency. According to one embodiment, determining the associated number of partial waveforms comprises determining a maximum number of partial waveforms for the playback frequency of the audio waveform.

According to one embodiment, obtaining the first data indicative of the set of partial waveforms comprises: sampling the audio waveform to generate a sampled waveform; transforming the sampled waveform from a time domain to a frequency domain to generate a frequency domain sampled waveform; and determining, based on the frequency domain sampled waveform, the set of partial waveforms for the audio waveform.

According to one embodiment, determining the associated number of partials for each note comprises: determining a supported sampling rate; and determining the associated number of partials for each note by dividing the supported sampling rate by a frequency of the associated note.

According to another aspect, a computer readable storage medium is provided. The computer-readable storage medium stores processor-executable instructions that, when executed by at least one processor, cause the at least one processor to: obtain first data indicative of a set of partial waveforms of an audio waveform; and generate a wave table for the audio waveform based on the set of partial waveforms, comprising: determine a set of notes, wherein each note has a corresponding entry in the wave table; determine, for each note in the set of notes, an associated number of partials for the note; and render, for each note in the set of notes, an associated waveform comprising the determined associated number of partials for the note from the set of partial waveforms.

According to one embodiment, the instructions are further configured to cause the processor to: determine a number of partial waveforms based on a sample rate, a playback frequency of the audio waveform, or both; and select, based on the first data and the number of partial waveforms, at least one waveform version from a set of waveform versions associated with the audio waveform to generate the audio waveform at the playback frequency, wherein each waveform version in the set of waveform versions comprises an associated different number of partial waveforms for the audio waveform.

According to one embodiment, selecting the waveform version comprises: selecting a first waveform version for generating a first portion of the audio waveform; and selecting a second waveform version for generating a second portion of the new audio waveform, wherein the selecting comprises determining a start location of the second waveform based on an end location of the first waveform. According to one embodiment, the instructions are further configured to cause the processor to resample the selected at least one waveform version to generate the new audio waveform at the playback frequency. According to one embodiment, determining the associated number of partial waveforms comprises determining a maximum number of partial waveforms for the playback frequency of the audio waveform.

According to one embodiment, obtaining the first data indicative of the set of partial waveforms comprises: sampling the audio waveform to generate a sampled waveform; transforming the sampled waveform from a time domain to a frequency domain to generate a frequency domain sampled waveform; and determining, based on the frequency domain sampled waveform, the set of partial waveforms for the audio waveform.

There has thus been outlined, rather broadly, the features of the disclosed subject matter in order that the detailed description thereof that follows may be better understood, and in order that the present contribution to the art may be better appreciated. There are, of course, additional features of the disclosed subject matter that will be described hereinafter and which will form the subject matter of the claims appended hereto. It is to be understood that the phraseology and terminology employed herein are for the purpose of description and should not be regarded as limiting.

BRIEF DESCRIPTION OF DRAWINGS

Various aspects and embodiments will be described with reference to the following figures. It should be appreciated that the figures are not necessarily drawn to scale. In the drawings, each identical or nearly identical component that is illustrated in various figures is represented by a like numeral. For purposes of clarity, not every component may be labeled in every drawing.

DETAILED DESCRIPTION

Figure 1:
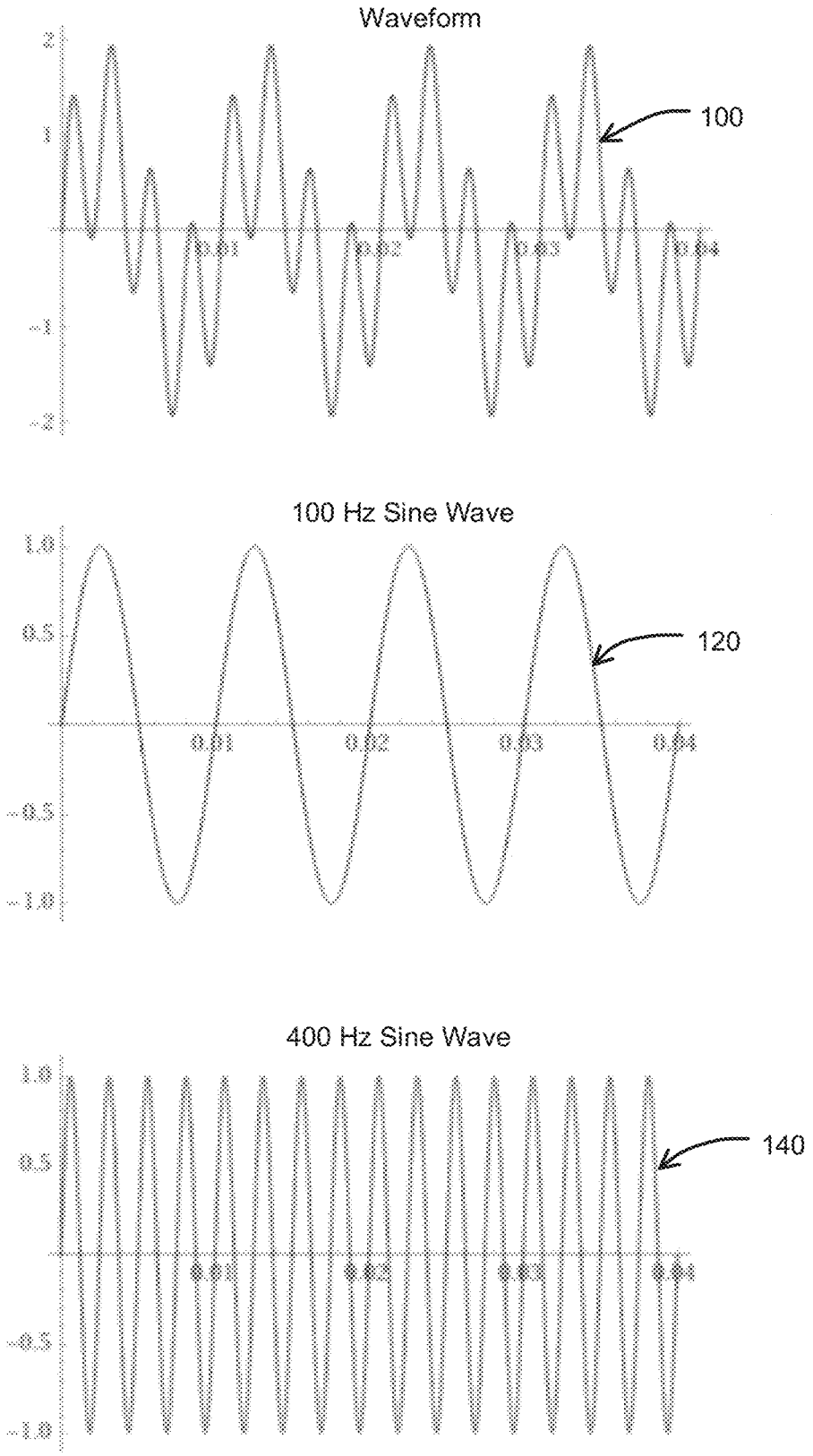
FIG. 1 shows an example of a waveform and its partial waveforms, according to some examples.

The inventors have recognized and appreciated that it can be desirable to emulate aspects of analog synthesizers, such as the ability to generate various audio waveforms at different musical pitches, in software. The inventors have further recognized and appreciated that it can be desirable to go beyond basic emulation of a few traditional oscillator waveforms to allow a user to create custom (e.g., arbitrary) wave shapes.

The inventors have further discovered and appreciated that it is desirable to be able to render the authored wave shapes at various frequencies (e.g., to render musical notes). However, while audio waveforms are often thought of as continuous signals of arbitrary length, with no upper bound on frequency content, that is not the case in the digital domain. For example, digital systems have certain limitations, and the intricacies of waveform processing in the digital domain can complicate the synthesis of arbitrary audio waveforms at different frequencies. For example, when arbitrary audio waveforms are converted to discrete-time signals, the system may reduce the fidelity of the ultimate waveform and/or create aliasing distortion.

As described herein, the inventors developed techniques for authoring arbitrarily shaped waveforms. The techniques can include determining the partial series of the authored waveform. The inventors have further developed techniques for generating a wave table for a waveform (e.g., for an authored waveform). The wave table can include various versions of the waveform, each with a different number of partial waveforms. Since each waveform version can be associated with a pitch range (e.g., a pitch range that can be resampled without reducing the fidelity of the waveform and/or creating aliasing distortion), the techniques can include selecting an appropriate waveform version from the wave table for processing (e.g., for resampling to obtain a desired frequency). The techniques can include linearly interpolating between multiple waveforms in the wave table so that each portion of the rendered audio leverages the best possible waveform. The techniques can be used to render these audio waveforms in various contexts, such as for a video game or for a multimedia experience that occurs in substantially real time on devices with limited processing power. For example, even on powerful devices, the audio rendering system performing the techniques described herein is just one of a number of software systems that need compute power to create the entire end-user experience. Therefore, the techniques can include providing additional processing efficiencies, as discussed herein.

Following below are more detailed descriptions of various concepts related to, and embodiments of, techniques for rendering arbitrary waveforms at various pitches. It should be appreciated that various aspects described herein may be implemented in any of numerous ways. Examples of specific implementations are provided herein for illustrative purposes only. In addition, the various aspects described in the embodiments below may be used alone or in any combination, and are not limited to the combinations explicitly described herein.

Generally, audio samples can be stored in memory as discretized waveforms, which can include a sampling rate and a corresponding Nyquist frequency, where the Nyquist frequency is half of the sampling rate of the waveform. FIG. 1 shows an example of a waveform 100 and its partial waveforms 120 and 140, according to some examples. The waveform 100 includes a fundamental partial frequency 120 of 100 Hz and an overtone partial frequency 140 of 400 Hz. In this simplified example, the waveform 100 includes the fundamental frequency 120 and one multiple of the fundamental frequency, the overtone frequency 140.

A waveform can be stored in a manner such that the waveform has been band limited at or below its Nyquist frequency before sampling (e.g., to avoid aliasing during playback of the discretized waveform). For example, systems can apply an anti-aliasing filter prior to sampling that attenuates frequencies above the highest frequency to be recreated during playback. For example, if the system has a waveform in memory that is already band limited such that there is minimal and/or no aliasing when the waveform is played at its original rate, then no additional aliasing (e.g., beyond any already in the waveform when it was created) should occur if the waveform is played back at its original pitch.

Various techniques can be used to obtain a waveform and/or a waveform's partial series (e.g., which the system can further process according to the techniques discussed herein). The partial series can include, for example, the amplitudes and phases of the sinewaves that, when combined, result in a pitched complex waveform. Examples of pitched complex waveforms include square waves, triangle waves, guitar string plucks, trumpet sounds, etc. The system can process an authored waveform to generate a wave table that can be used to generate different pitches of the authored waveform, as discussed further in conjunction with FIGS. 4A-4B.

In some embodiments, the techniques can use models of analog synthesizer waveforms to mathematically determine the partial series. For example, common waveforms include a triangle waveform, a sawtooth waveform, and/or a square waveform. A triangle waveform can contain partials at the odd frequencies, with amplitudes at the inverse of the square of the harmonic number (e.g., $1/3^2$, $1/5^2$, etc.). A sawtooth waveform can include all harmonic partials with amplitudes as the inverse of the harmonic number. A square waveform can contain odd partials with amplitudes at the inverse of the partial number.

In some embodiments, the number of partials can be limited, e.g., since otherwise any number of partials could be determined when using mathematical techniques. In some embodiments, the Nyquist frequency can be used to limit the number of partials. For example, as described herein the system can be configured such that it does not reproduce a partial above the Nyquist frequency of the sample rate that the system is using for rendering.

In some embodiments, the system can limit the number of partials based on the volume of the fundamental. For example, the system can be configured to not render any more partials once their volume drops below a certain configured metric below the volume of the fundamental. For example, a metric of −96 dB can be used since digital audio is typically stored at a resolution of 16 bits per sample, which limits the dynamic range to 96 dB between silence and the loudest representable number. Decibels can be converted into a fraction, or gain, using the formula $gain=10^{(X\ dB/20)}$. Therefore, for −96 dB, the $gain=10^{(-96/20)}$, which is approximately equal to 0.000016. Assuming the fundamental sinewave is at a gain of 1, and given the formula for a given waveform (e.g., including the fact that the partials diminish in volume as the partial number goes up), the number of partials before their volume reaches 0.000016 can be determined. For example, for a square wave, which has odd partials with amplitudes that are the inverse of the partial number, a square wave has 62,501 partials (i.e., 1/0.000016).

In some embodiments, the system can be configured to (further) limit the number of partials based on the sample rate at which the system will be rendering the waveforms. For example, if using the MIDI specification, a waveform need not be rendered for a pitch below ~8.662 Hz, which is the frequency of the lowest MIDI note. Given that as the fundamental frequency, the render sample rate's Nyquist frequency can be divided by 8.662 Hz to determine how many partials could potentially be needed (but which may not be needed). For example, if the render sample rate is 48 kHz and therefore Nyquist is 24 kHz, then 24,000 Hz/8.662 Hz is ~2770 partials. As shown, this number does not depend on the waveform shape, rather it is a constant given the lowest pitch desired to be rendered and the rendering sample rate.

In some embodiments, the tools can, in addition or alternatively, allow a user to author custom, arbitrary waveforms by specifying the partial series. For example, in some embodiments, additive synthesis authoring tools can be used to create a partial series representation of a waveform. In some embodiments, a tool can include one or more techniques that allow a user to specify the volume and phase of each partial. For example, some tools can specify the partials using a text editor. As another example, a graphical user interface can present a series of sliders, including a slider for each partial such that the user can set the volume/amplitude and phase of each partial. A user can author any number of partials up to a predetermined limit, if any (e.g., given the lowest pitch desired to be rendered and the sample rate, as discussed above).

Figure 3:
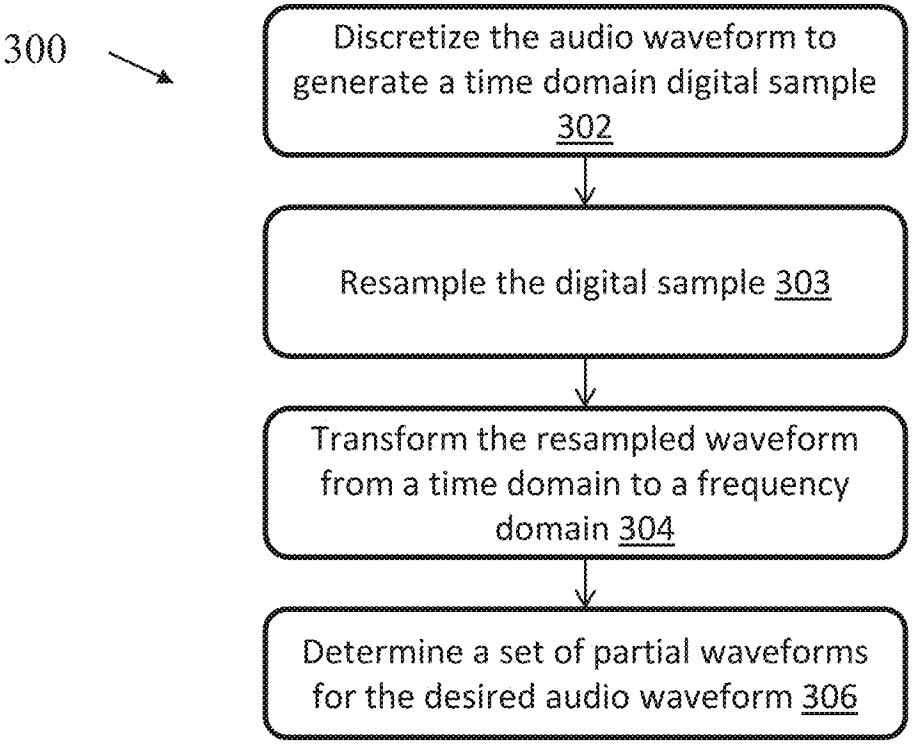
FIG. 3 shows an exemplary method of determining the partial series for a waveform, according to some embodiments.

In some embodiments, the tools can allow a user to sample a pitched analog waveform (e.g., using a microphone). The system can convert the sampled analog waveform to a partial series in the digital domain. FIG. 3 shows an exemplary method 300 of determining the partial series for a sampled analog waveform, according to some embodiments. At step 302, the system is configured to discretize the analog waveform. At step 303, the system is configured to resample the waveform from step 302. At step 304, the system is configured to transform the resampled waveform from the time domain to the frequency domain. At step 306, the system is configured to determine a set of partial waveforms for the desired audio waveform.

Referring to step 302, the analog waveform can be discretized through techniques of audio sampling, including band limiting the analog waveform to remove content above the Nyquist frequency, and measuring the analog voltage at fixed intervals (e.g., the sampling rate) to create a time domain digital sample.

Referring to step 303, the system can choose a resample rate based on the fundamental pitch of the sampled waveform and its original sample rate, and the waveform can be resampled to the new rate. In some embodiments, the new rate is chosen such that the fundamental pitch of the waveform falls on one specific bin of the frequency domain representation, and/or such that aliasing is not added during this resampling. For example, assume an analog waveform has a fundamental pitch of 440 Hz, sampled at an original sample rate of 48 kHz, and therefore with a Nyquist frequency at 24 kHz. For harmonic partial series, the partials will be some multiple of the fundamental pitch, and the system can be configured to only include the partials that are below the Nyquist frequency. The number of partials that fall completely below Nyquist can be determined by dividing the original sampling rate by the fundamental pitch. Using this example, 24,000/440 is ~54.5, and therefore 54 partials fall below Nyquist. A constraint can include a lower limit on the new sample rate. In some embodiments, the sample rate can be set to be at least as often as the original sample rate (e.g., since resampling lower than the original rate can introduce aliasing).

Referring to steps 303 and 304, the system is configured to transform the resampled waveform from the time domain to the frequency domain. In some embodiments, the system is configured to perform a fast Fourier transform (FFT) to get the frequency domain representation of the sampled waveform. The FFT size can be determined based on the number of partials below Nyquist. For example, the FFT size can be at least 55 bins in size, given the 54 partials plus a zero'th bin that represents DC.

In some embodiments, the frequency of each bin in an FFT can be calculated with the formula B*Fs/N, where B is the bin index, Fs is the sample rate, and N is the size of the FFT. Continuing with the example above, N has to be at least 55, and Fs has to be at least at least 48 kHz, such that 440=1*48000/N. Solving for N, that results in 109.09 bins, which can be rounded up to 110. Solving for the sample rate Fs, 440=1*Fs/110, which is 48.4 kHz. In some embodiments, the bin count can be altered to achieve optimizations in the Fourier transform. For example, 128 bins may be chosen, which would result in a resample rate of 56320 samples per second.

Referring to step 306, the system is configured to determine a set of partial waveforms for the desired audio waveform. In some embodiments, the FFT result can be used to determine the partial series. For example, in the frequency domain arrived at with an FFT, the bin spacing can be determined by dividing the sample rate by the FFT size. As described herein, the techniques can be configured to perform an FFT with an FFT size that is equal to the number of samples. Therefore, for such an FFT, the first bin is the DC component. The second bin is the fundamental or first partial, the third bin is the second partial (e.g., 2 times the fundamental frequency), the fourth bin is the third partial (e.g., 3 times the fundamental), and so on.

In some embodiments, the system can be configured to calculate partial amplitudes and/or phases based on the FFT result. The time domain, resampled, digital sample can be converted to the frequency domain using the bin count (e.g., as calculated above). The frequency domain representation (e.g., complex numbers on the z-plane) can be evaluated to determine the partial series (e.g., amplitudes based on the real part of the complex number and phases based on the imaginary part of the complex number). The resulting partial series includes just the partials that fall between the original pitch of the digital sample and the Nyquist frequency, given its original sampling rate (e.g., since higher partials can be removed as described above).

In some embodiments, the system can be configured to process only a subset of the total FFT bins. For example, each particular application may only require a certain number of partials. As explained further herein as an example, for a system sample rate ($F_s$)=48000 samples/sec (Nyquist ($F_n$)=24000 Hz) and a lowest-supported frequency for playback ($F_l$)=8.662 Hz, Equation 1 discussed below shows that the total number of partials $P_t$~=2770. Therefore, the system can be configured to keep only the bottom 2770 partials (e.g., based on the lowest 2770 FFT bins).

In some embodiments, the tools can be configured to allow the user to hand-draw the shape of a waveform. For example, a user can specify an arbitrary shape of the waveform. A user can be presented with various drawing tools, ranging from a text editor that allows the user to specify how the waveform should be shaped at various points, or a GUI that allows the user to draw the shape. In some embodiments, the techniques can resample the authored waveform using techniques similar to those described herein (e.g., those described for sampling an analog waveform). For example, the hand-drawn waveform can be resampled as discussed in conjunction with sampling an analog waveform. In some embodiments, a hand-drawn waveform can contain discontinuities that result in frequencies well above the resample rate's Nyquist frequency. Such discontinuities can be mitigated by over-sampling, filtering the waveform, and then down sampling, which can reduce the potential effects of aliasing that could be created from sampling a hand specified waveform. The number of partials of a hand-drawn waveform can be determined by choosing a sampling rate that works best given the range of pitches (fundamental frequencies) desired to reproduce and the rendering sample rate.

In some embodiments, the system can be configured to process the partial series for later use, such as during a video game or multimedia experience. In the digital context, a technique that can be used to render a waveform at different pitches can include interpolating between the audio samples of the waveform that are saved in memory. A discretized waveform can be sampled at different rates (e.g., using linear interpolation) to generate different pitches. For example, if a band limited waveform is sampled at a lower rate to generate a lower pitch, no additional aliasing should occur. However, issues can occur depending on the sampling. For example, at some point as the waveform is sampled at lower and lower rates (e.g., for lower pitches), the reproduced audio waveform may not include the highest possible number of partial waveforms (e.g., multiples of the fundamental frequency of the waveform) that would naturally occur at that pitch. For example, those partial waveforms, or partials, may have been band-limited out when the original waveform was created. As another example, conversely, as the waveform is sampled at higher and higher rates (for higher pitches), aliasing can occur because the waveform in memory has high partials that are being transposed up above the Nyquist frequency.

Therefore, the inventors have discovered and appreciated that waveforms can include associated audio processing limitations when trying to modify the pitch of the stored waveform. Some exemplary audio processing limitations of the waveform processing can include partials becoming inaudible at certain pitches. For example, for the next partial of a waveform that is above Nyquist, as the waveform is played at a lower and lower pitch, that partial moves downward toward the Nyquist cutoff. At some point, as the pitch is lowered that partial finally moves below Nyquist and is therefore not rendered as part of the audible waveform, which can reduce the fidelity of the audio waveform. However, the inventors have appreciated that it is desirable to be able to hear such partials. Other exemplary audio processing limitations include aliasing. For example, for the partial of a waveform that is just below Nyquist, as the waveform is played at a higher and higher pitch, that partial will move closer and closer to the Nyquist frequency until finally it moves above the Nyquist frequency and creates aliasing distortion. The inventors have appreciated that it is desirable to avoid such aliasing distortion.

Figure 2:
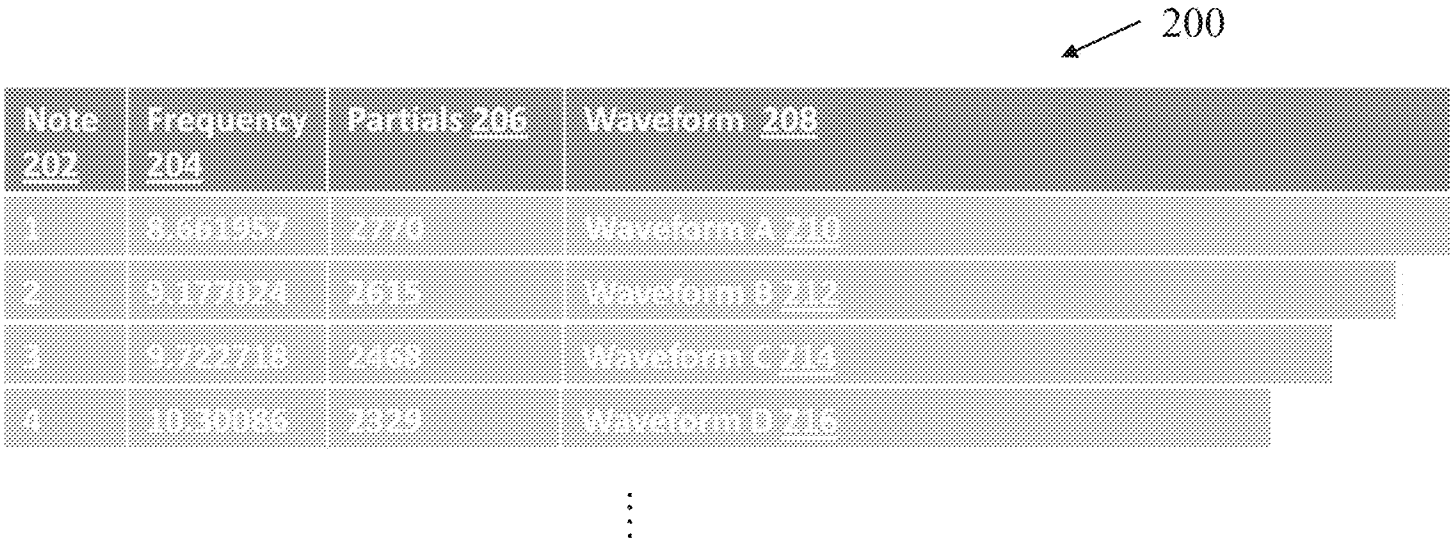
FIG. 2 shows an exemplary wave table, according to some embodiments.

The inventors have developed techniques to overcome these and other limitations when processing waveforms. The techniques can include, for a particular waveform, storing a plurality of versions of the waveform (e.g., in a wave table) such that each version includes a different number of partials. FIG. 2 shows an exemplary wave table 200, according to some embodiments. The wave table 200 shows a note number 202 (e.g., 1, 2, 3, and so on), a frequency of each note (e.g., 8.661957 Hz for note 1), the number of partials 206, and a waveform 208 for each wave table entry, including waveforms A 210, B 212, C 214, D 216, and so on. Waveform A 210 includes 2,770 partials, waveform B 212 includes 2615 partials, and so on. As discussed further herein, the number of partials 206 is the number of partials that would be possible at a sample rate of 48 kHz (Nyquist at 24 kHz), according to some embodiments. Therefore, various waveforms can be stored in a wave table. Each waveform 208 in the table is the same waveform, rendered with a different number of partials. It should be understood that various structures can be used to store the wave table, such as a database, two- or three-dimensional arrays, linked lists, and/or the like, without departing from the spirit of the invention.

Figure 4A:
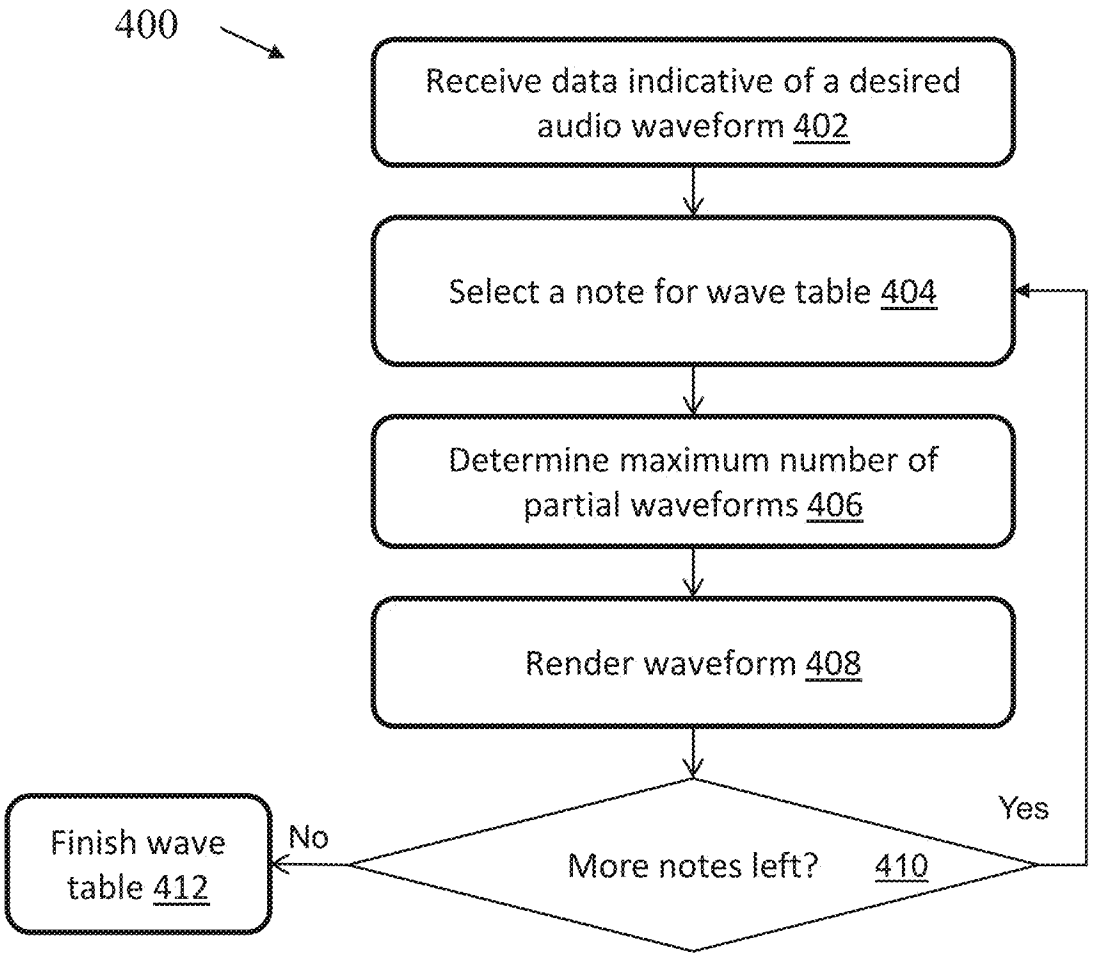
FIG. 4A shows an exemplary computerized method for generating a wave table, according to some embodiments.

FIG. 4A shows an exemplary computerized method 400 for generating a wave table, according to some embodiments. At step 402, the system receives data indicative of an audio waveform, such as a partial series of the waveform. At step 404, the system selects a note or frequency for a wave table entry. At step 406, the system determines the maximum number of partial waveforms for the selected note. At step 408, the system renders the waveform for the entry for the note in the wave table with the number of partial waveforms determined at step 406. At step 410, the system determines whether there are any additional notes left to create entries for in the wave table. If yes, the method proceeds back to step 404 for a new note. If no, the system proceeds to step 412 and completes creating the wave table.

Referring to step 402, the system receives data indicative of an audio waveform and/or its partial series. In some embodiments, the system receives the partial series. In some embodiments, the system receives an authored waveform and determines the partial series of the waveform. As discussed in conjunction with FIG. 3, the audio waveform can be an authored waveform, a sampled analog waveform, and/or the like. Depending on the format, the system can determine the partial series of the authored waveform for rendering the wave table, as described herein.

Referring to step 404, the system selects a note or frequency for a particular entry of the wave table 404. For example, referring to FIG. 2, the system can start by selecting MIDI note #1. While this example uses MIDI notes, any type of note can be used to build the wave table. For example, instruments may have a set of notes that can be used to create the wave table. As an illustrative example, a piano has a set of discrete notes that can be used to build the wavetable, such as by creating an entry for each note of the piano.

Referring to step 406, the system determines the maximum number of partial waveforms for the wave table entry. The number of partials stored in the wave table for each entry can be dependent on certain factors, such as the playback sample rate of the system. The following equation can be used to determine the total number of partials, $P_t$, necessary for storing in the wave table:

$$P_t = F_n / F_l \qquad \text{Equation 1}$$

where:

$F_n$ is the Nyquist frequency; and $F_t$ is the lowest frequency the system will allow for playback.

For an example, assume the system sample rate ($F_s$)=48000 samples/sec, which makes Nyquist ($F_n$)=24000 Hz. Assume the lowest frequency that the system will allow for playback ($F_l$)=8.662 Hz (e.g., which is approximately the frequency of MIDI note number 1, as shown in the wave table 200 in FIG. 2). As discussed herein, each partial is a multiple of the fundamental frequency. Using Equation 1, $P_t$=24000/8.662~=2770 partials.

The sample rate can be determined when beginning the process to generate the wave table (e.g., at boot time or load time), and therefore the wave table can be dynamically generated based on the particular system environment. For example, some devices may include an audio synthesizer with a sampling rate of 48 kHz, while others may have a lower sampling rate, such as 24 kHz or 36 kHz. The system can determine the supported sampling rate of the system and use the sampling rate to dynamically build the wave table.

Referring to step 408, the waveforms can be created using, for example, additive synthesis (e.g., summing sinewaves at the appropriate frequency and amplitude), inverse FFT (e.g., by first taking the partial series and converting the amplitudes and phases into complex z-plane representations), and/or the like. The wave table can be created in advance, such as by using a tool and saving the wave table into a file, and/or can be generated at runtime (e.g., in which case the partial series is stored persistently).

Referring further to step 408, the system can determine the buffer size required for each waveform. For example, for the lowest pitch waveform the system can determine the highest partial up to Nyquist, at which point there will only be 2 samples per cycle. Equation 2 can be used to calculate $S_c$, which is the required buffer size in samples:

$$S_c = P_t \times 2 \qquad \text{Equation 2}$$

Continuing with the example above, the buffer size for the one version of the lowest pitch waveform is $S_c$=2770*2=5540. Referring to steps 404-410, the system can be configured to render additional versions of the waveform, such as each possible version of this waveform (e.g., every possible partial count). To render every version of the waveform from 1 partial to 2770 partials, the total buffer size in samples ($S_t$) can be calculated as:

$$St = \sum_{k=1}^{2770} 2k \qquad \text{Equation 3}$$

Continuing further with our example, the total buffer size would be $S_t$=7,675,670. The ultimate size can depend on the number of bits used to store the samples. For example, if using 32-bit floating-point numbers, the buffer size would need to be about 30 MB (e.g., 7,675,670×32 bits/8 bits per byte).

The techniques can include reducing the overall number of partials, e.g., to save space and/or processing requirements. For example, techniques can be used to reduce the number of partials to a set that provides an acceptable reproduction fidelity. For example, since the maximum number of partials depends on the system sample rate as shown in Equation 1 (e.g., since the sample rate affects Nyquist), the sample rate can be lowered. As another example, the system can be configured to limit the maximum number of partials that are rendered. Such a limit may not significantly affect rendering. For example, limiting the number of partials may not allow each and every partial being played back that would otherwise be allowed based on the system sample rate, however it may be rare for this to occur regardless (e.g., it may be rare that any sample is actually rendered at 8.662 Hz).

As another example, the system can be configured not to render a waveform for every sequential number of partials (e.g., from 1 to 2770 in the example discussed herein). Referring further to the wave table 200 shown in FIG. 2, there are gaps in the partial counts for the MIDI note numbers. For example, while MIDI note #1 can have up to 2,770 partials, the next MIDI note #2 can only have 2,615, which is a difference of 155 partials compared to MIDI note #1. The system can be configured to only render waveforms to support the note frequencies of the system (e.g., for just the MIDI note frequencies). While such an approach may not address every possible rendering situation, it can be a viable tradeoff in terms of space saving. For example, a musician could use a pitch bend wheel or modulation to generate frequencies between the MIDI notes, and therefore may not have a perfect match to the waveform versions in the wave table. But for purposes of memory optimization, it can be desirable to forego "perfect" rendering at such frequencies since the wave table could still be used to render the waveform. For example, the system could be configured to just resample the waveform that has fewer partials than would otherwise be renderable (e.g., by resampling the waveform that was rendered for the nearest higher MIDI note). As an example, adding up the partials for the various MIDI notes, applying such techniques could require needing 98,330 total samples for all "MIDI note" waveforms. Storing 98,330 total samples could only require about 384 KB of memory (e.g., compared to 30 MB otherwise).

The wave table (e.g., stored in memory) includes the same waveform, defined by its partial series, rendered with varying numbers of its partials for each version. The different versions of the waveform in the wave table can facilitate generating different pitches of the authored waveform (e.g., in a manner that preserves fidelity and avoids aliasing). To create a rendered waveform for a given pitch range, the system can determine one or more attributes, such as the number of partials that need to be rendered, the magnitude (volume) of each partial, the phase of each partial, and/or the like. The system can use this and/or other information to select a particular version of the waveform in the wave table for processing to render the waveform with the desired pitch.

Figure 4B:
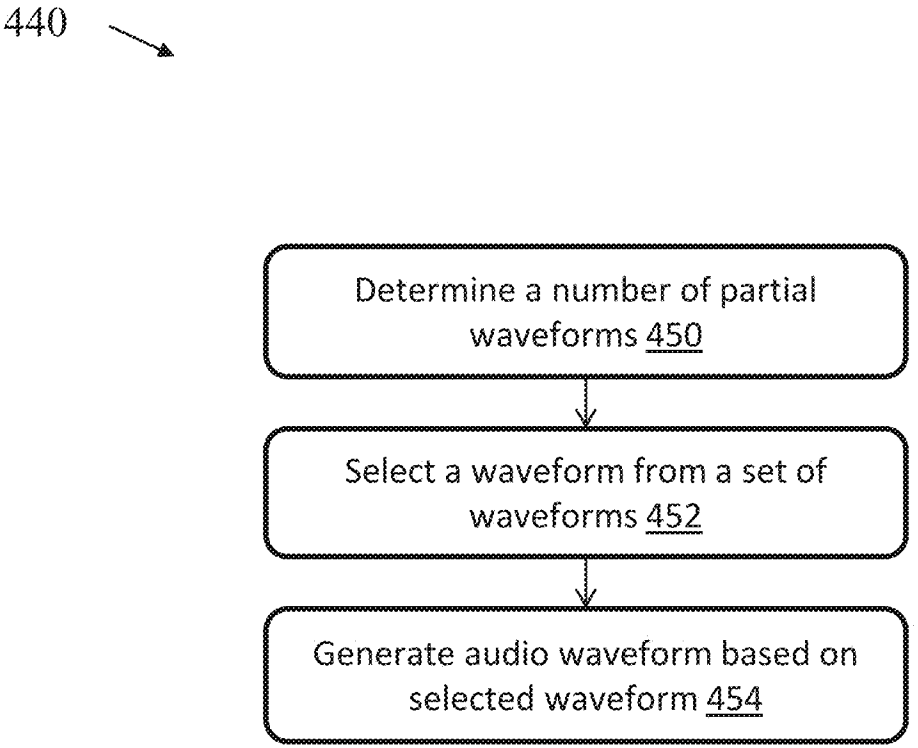
FIG. 4B shows an exemplary computerized method for generating a waveform with a desired pitch using a wave table, according to some embodiments.

FIG. 4B shows an exemplary computerized method 440 for generating a waveform with a desired pitch using a wave table, according to some embodiments. At step 450, the system determines a number of partial waveforms for the ultimate waveform (e.g., at the desired pitch). At step 452, the system selects a waveform version from the wave table (e.g., which includes a set of different versions of the authored waveform, where each version has an associated different number of partial waveforms generated based on the authored waveform) based on the number of partial waveforms associated with the desired audio waveform at the particular pitch. At step 454, the system generates the audio waveform at the desired pitch using the selected version of the waveform from the wave table. Steps 450-454 therefore leverage the wave table (e.g., generated as described in conjunction with FIG. 4A) to produce the ultimate waveform at a desired pitch.

Referring to step 450, in some embodiments, the system can receive an incoming note (e.g., MIDI note) that is to be rendered using the wave table. The system can convert the desired note to a fundamental frequency. In some embodiments, rather than receiving a note, the system can receive the desired fundamental frequency. The system can add or subtract from that frequency, as necessary, such as based on other controllers (e.g., other MIDI controllers, such as a pitchbend wheel, or requests from other code logic). The system determines a number of partial waveforms for the final desired frequency. The system can determine the number of partial waveforms based on various parameters, such as based on the sample rate, the playback frequency of the desired audio waveform, or both. For example, for a particular system sample rate and a desired playback frequency, the system can calculate the maximum number of partials possible at that frequency. For example, for a 48 kHz rendering sample rate and a desired frequency of the waveform of 440 Hz, the maximum number of partials below Nyquist are 54.5 as discussed herein. Rounding down to the nearest whole integer is 54 partials (which includes the fundamental frequency as well as 53 additional partials).

At step 452, the system selects a waveform version from the wave table based on the number of determined partial waveforms at step 450. For example, the system can select the waveform version from the table that has the number of partials determined at step 450. If techniques are used to reduce the number of waveform versions as discussed herein, there may not be a waveform version in the wave table with the same number of partials determined at step 450. The system can therefore be configured to select a next-closest version, such as the version with the next-fewer number of partials.

At step 454, the system generates the audio waveform at the desired pitch using the selected version of the waveform from the wave table. In some embodiments, the system can resample the selected waveform to generate the audio waveform at the requested playback pitch.

Each version of a waveform can be sampled at different pitches. For a given (e.g., band limited) waveform version in memory (e.g., waveform A 210), there can be a certain range of playback pitch where that waveform contains all possible partials below Nyquist, and only those partials. The system can be configured to resample this waveform over that range of pitch (e.g., without risk of losing partials and/or aliasing). If the system needs to resample the waveform beyond that range, the system can be configured to switch to another version of the waveform with a different number of partials (e.g., waveform B 212, waveform C 214, and/or the like). The other waveforms each, in-turn, have a different associated range of playback pitch, e.g., without risk of losing partials or aliasing. For example, for a particular waveform, if the pitch is increased beyond the range for that waveform, the techniques can select a new waveform with fewer partials as the pitch is increased to avoid aliasing. If the pitch is lowered beyond the range supported by a waveform, the techniques can select a new waveform with more partials to use the best quality waveform available. Thus, the system can use the various versions of the waveform in the wave table to choose the best version for the particular desired tone of the waveform, such that the selected waveform can provide the desired tone with the most number of partials for the best audio quality while avoiding aliasing.

In some embodiments, the techniques can use multiple waveforms. For example, the system can start rendering audio based on a first waveform, and as the pitch is increased or decreased, the system can switch to using a different waveform. As shown in FIG. 2, the size of each waveform A 210, B 212, and so on is smaller or larger depending on the playback time of the waveform (as well as the amount of storage required to store the waveform with the associated partials, as discussed herein). In order to switch between different waveforms in the wave table without creating perceivable distortions, the system can keep track of its location in a particular waveform and use the location to jump to the proper location of the next waveform. In some embodiments, the system can use a floating point number to represent the start (e.g., at 0) and end (e.g., at 1) of each waveform, and keep track of the position of the waveform accordingly. For example, if the system has rendered up to 0.5 way through a particular waveform, the system can jump to 0.5 of the way through the next waveform.

Figure 5:
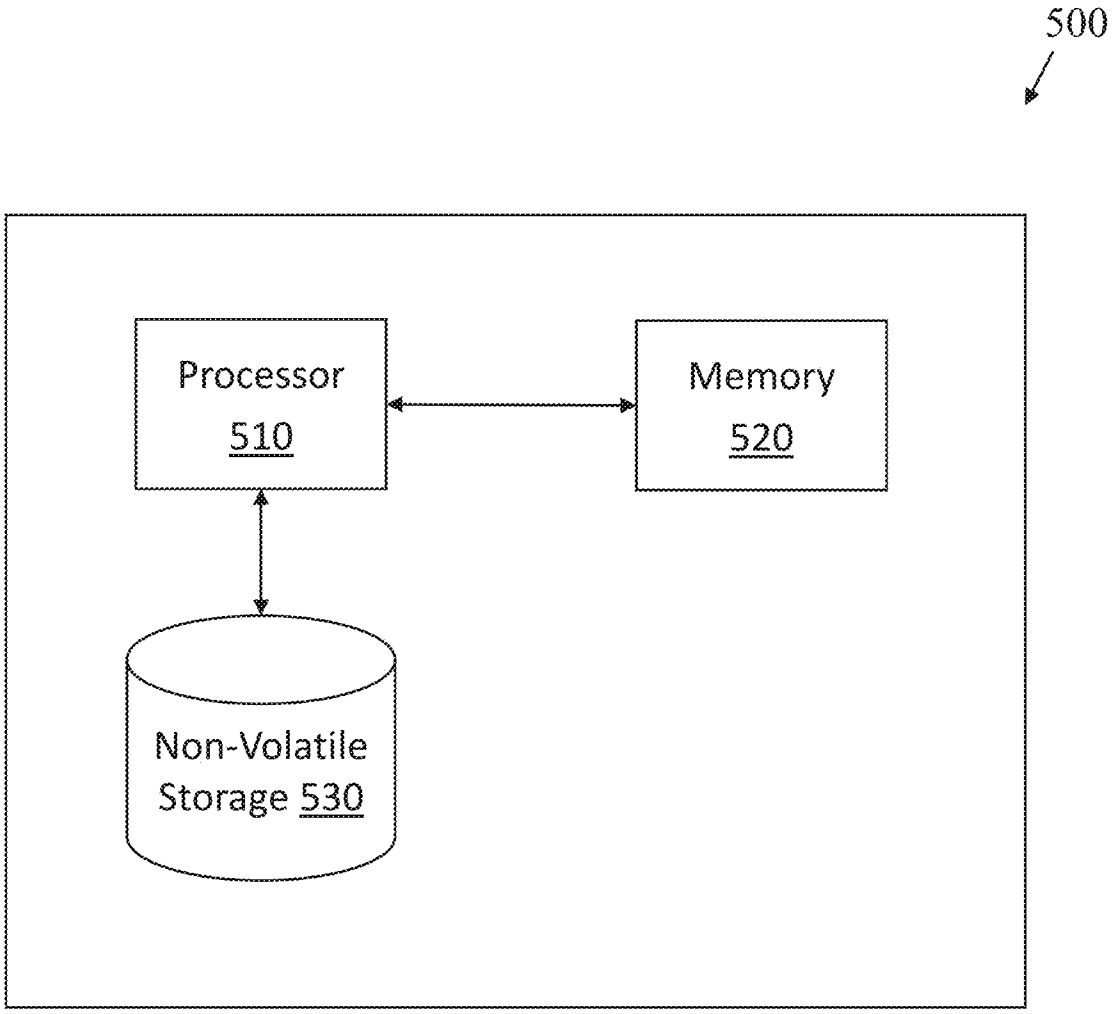
FIG. 5 shows an illustrative implementation of a computer system that may be used to perform any of the aspects of rendering audio waveforms, according to some embodiments.

An illustrative implementation of a computer system 500 that may be used to perform any of the aspects of rendering audio waveforms as discussed herein is shown in FIG. 5. The computer system 500 may include one or more processors 510 and one or more non-transitory computer-readable storage media (e.g., memory 520 and one or more non-volatile storage media 530). The processor 510 may control writing data to and reading data from the memory 520 and the non-volatile storage device 530 in any suitable manner, as the aspects of the invention described herein are not limited in this respect. To perform functionality and/or techniques described herein, the processor 510 may execute one or more instructions stored in one or more computer-readable storage media (e.g., the memory 520, storage media, etc.), which may serve as non-transitory computer-readable storage media storing instructions for execution by the processor 510.

In connection with techniques described herein, code used to, for example, provide tools for authoring a waveform, generating a wave table, and/or resampling a waveform to create a desired pitch, etc. may be stored on one or more computer-readable storage media of computer system 500. Processor 510 may execute any such code to provide any techniques for authoring waveforms as described herein. Any other software, programs or instructions described herein may also be stored and executed by computer system 500. It will be appreciated that computer code may be applied to any aspects of methods and techniques described herein. For example, computer code may be applied to interact with an operating system to author and/or process waveforms through conventional operating system processes.

The various methods or processes outlined herein may be coded as software that is executable on one or more processors that employ any one of a variety of operating systems or platforms. Additionally, such software may be written using any of numerous suitable programming languages and/or programming or scripting tools, and also may be compiled as executable machine language code or intermediate code that is executed on a virtual machine or a suitable framework.

In this respect, various inventive concepts may be embodied as at least one non-transitory computer readable storage medium (e.g., a computer memory, one or more floppy discs, compact discs, optical discs, magnetic tapes, flash memories, circuit configurations in Field Programmable Gate Arrays or other semiconductor devices, etc.) encoded with one or more programs that, when executed on one or more computers or other processors, implement the various embodiments of the present invention. The non-transitory computer-readable medium or media may be transportable, such that the program or programs stored thereon may be loaded onto any computer resource to implement various aspects of the present invention as discussed above.

The terms "program," "software," and/or "application" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor, but may be distributed in a modular fashion among different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in non-transitory computer-readable storage media in any suitable form. Data structures may have fields that are related through location in the data structure. Such relationships may likewise be achieved by assigning storage for the fields with locations in a non-transitory computer-readable medium that convey relationship between the fields. However, any suitable mechanism may be used to establish relationships among information in fields of a data structure, including through the use of pointers, tags or other mechanisms that establish relationships among data elements.

Various inventive concepts may be embodied as one or more methods, of which examples have been provided. The acts performed as part of a method may be ordered in any suitable way. Accordingly, embodiments may be constructed in which acts are performed in an order different than illustrated, which may include performing some acts simultaneously, even though shown as sequential acts in illustrative embodiments.

The indefinite articles "a" and "an," as used herein in the specification and in the claims, unless clearly indicated to the contrary, should be understood to mean "at least one." As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This allows elements to optionally be present other than the elements specifically identified within the list of elements to which the phrase "at least one" refers, whether related or unrelated to those elements specifically identified.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Use of ordinal terms such as "first," "second," "third," etc., in the claims to modify a claim element does not by itself connote any priority, precedence, or order of one claim element over another or the temporal order in which acts of a method are performed. Such terms are used merely as labels to distinguish one claim element having a certain name from another element having a same name (but for use of the ordinal term).

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the invention in detail, various modifications and improvements will readily occur to those skilled in the art. Such modifications and improvements are intended to be within the spirit and scope of the invention. Accordingly, the foregoing description is by way of example only, and is not intended as limiting.

Various aspects are described in this disclosure, which include, but are not limited to, the following aspects:

1. A computer-implemented method of generating an audio waveform at a playback frequency, the method comprising: obtaining first data indicative of a set of partial waveforms of the audio waveform; and generating a wave table for the audio waveform based on the set of partial waveforms, the generating comprising: determining a set of notes, wherein each note has a corresponding entry in the wave table; determining, for each note in the set of notes, an associated number of partials for the note; and rendering, for each note in the set of notes, an associated waveform comprising the determined associated number of partials for the note from the set of partial waveforms.

2. The method of aspect 1, further comprising: determining a number of partial waveforms based on a sample rate, a playback frequency of the audio waveform, or both; and selecting, based on the first data and the number of partial waveforms, at least one waveform version from a set of waveform versions associated with the audio waveform to generate the audio waveform at the playback frequency, wherein each waveform version in the set of waveform versions comprises an associated different number of partial waveforms for the audio waveform.

3. The method of aspect 2, wherein selecting the at least one waveform version comprises: selecting a first waveform version for generating a first portion of the audio waveform; and selecting a second waveform version for generating a second portion of the audio waveform, the selecting comprising determining a start location of the second waveform based on an end location of the first waveform.

4. The method of aspect 2, further comprising resampling the selected at least one waveform version to generate the audio waveform at the playback frequency.

5. The method of aspect 2, wherein determining the associated number of partial waveforms comprises determining a maximum number of partial waveforms for the playback frequency of the audio waveform.

6. The method of aspect 1, wherein obtaining the first data indicative of the set of partial waveforms comprises: sampling the audio waveform to generate a sampled waveform; transforming the sampled waveform from a time domain to a frequency domain to generate a frequency domain sampled waveform; and determining, based on the frequency domain sampled waveform, the set of partial waveforms for the audio waveform.

7. The method of aspect 1, wherein determining the associated number of partials for each note comprises: determining a supported sampling rate; and determining the associated number of partials for each note by dividing the supported sampling rate by a frequency of the associated note.

8. A system for generating an audio waveform at a playback frequency, the system comprising: a processor in communication with a memory, wherein the memory is configured to store machine readable instructions that, when executed by the processor, cause the processor to: obtain first data indicative of a set of partial waveforms of an audio waveform; and generate a wave table for the audio waveform based on the set of partial waveforms, comprising: determine a set of notes, wherein each note has a corresponding entry in the wave table; determine, for each note in the set of notes, an associated number of partials for the note; and render, for each note in the set of notes, an associated waveform comprising the determined associated number of partials for the note from the set of partial waveforms.

9. The system of aspect 8, wherein the instructions are further configured to cause the processor to: determine a number of partial waveforms based on a sample rate, a playback frequency of the audio waveform, or both; and select, based on the first data and the number of partial waveforms, at least one waveform version from a set of waveform versions associated with the audio waveform to generate the audio waveform at the playback frequency, wherein each waveform version in the set of waveform versions comprises an associated different number of partial waveforms for the audio waveform.

10. The system of aspect 9, wherein selecting the at least one waveform version comprises: selecting a first waveform version for generating a first portion of the audio waveform; and selecting a second waveform version for generating a second portion of the new audio waveform, wherein the selecting comprises determining a start location of the second waveform based on an end location of the first waveform.

11. The system of aspect 9, wherein the instructions are further configured to cause the processor to resample the selected at least one waveform version to generate the audio waveform at the playback frequency.

12. The system of aspect 9, wherein determining the associated number of partial waveforms comprises determining a maximum number of partial waveforms for the playback frequency of the audio waveform.

13. The system of aspect 8, wherein obtaining the first data indicative of the set of partial waveforms comprises: sampling the audio waveform to generate a sampled waveform; transforming the sampled waveform from a time domain to a frequency domain to generate a frequency domain sampled waveform; and determining, based on the frequency domain sampled waveform, the set of partial waveforms for the audio waveform.

14. The system of aspect 8, wherein determining the associated number of partials for each note comprises: determining a supported sampling rate; and determining the associated number of partials for each note by dividing the supported sampling rate by a frequency of the associated note.

15. At least one computer readable storage medium storing processor-executable instructions that, when executed by at least one processor, cause the at least one processor to: obtain first data indicative of a set of partial waveforms of an audio waveform; and generate a wave table for the audio waveform based on the set of partial waveforms, comprising: determine a set of notes, wherein each note has a corresponding entry in the wave table; determine, for each note in the set of notes, an associated number of partials for the note; and render, for each note in the set of notes, an associated waveform comprising the determined associated number of partials for the note from the set of partial waveforms.

16. The at least one computer readable storage medium of aspect 15, wherein the instructions are further configured to cause the processor to: determine a number of partial waveforms based on a sample rate, a playback frequency of the audio waveform, or both; and select, based on the first data and the number of partial waveforms, at least one waveform version from a set of waveform versions associated with the audio waveform to generate the audio waveform at the playback frequency, wherein each waveform version in the set of waveform versions comprises an associated different number of partial waveforms for the audio waveform.

17. The at least one computer readable storage medium of aspect 16, wherein selecting the waveform version comprises: selecting a first waveform version for generating a first portion of the audio waveform; and selecting a second waveform version for generating a second portion of the new audio waveform, wherein the selecting comprises determining a start location of the second waveform based on an end location of the first waveform.

18. The at least one computer readable storage medium of aspect 16, wherein the instructions are further configured to cause the processor to resample the selected at least one waveform version to generate the new audio waveform at the playback frequency.

19. The at least one computer readable storage medium of aspect 16, wherein determining the associated number of partial waveforms comprises determining a maximum number of partial waveforms for the playback frequency of the audio waveform.

20. The at least one computer readable storage medium of aspect 15, wherein obtaining the first data indicative of the set of partial waveforms comprises: sampling the audio waveform to generate a sampled waveform; transforming the sampled waveform from a time domain to a frequency domain to generate a frequency domain sampled waveform; and determining, based on the frequency domain sampled waveform, the set of partial waveforms for the audio waveform.

What is claimed is:

1. A computer-implemented method of generating an audio waveform at a playback frequency, the method comprising:

obtaining first data indicative of a set of partial waveforms of the audio waveform; and generating a wave table for the audio waveform based on the set of partial waveforms, the generating comprising:

determining a set of notes, wherein each note has a corresponding entry in the wave table;

for each note in the set of notes:

determining an associated number of partials for the note;

rendering an associated waveform version of the audio waveform comprising the determined associated number of partials for the note from the set of partial waveforms; and storing, in the corresponding entry of the note in the wave table, the associated waveform version.

2. The method of claim 1, further comprising:

determining a number of partial waveforms based on a sample rate, a playback frequency of the audio waveform, or both; and selecting, based on the first data and the number of partial waveforms, from the wave table, at least one waveform version of the audio waveform to generate the audio waveform at the playback frequency, wherein each waveform version stored in the wave table comprises a different number of partial waveforms for the audio waveform.

3. The method of claim 2, wherein selecting the at least one waveform version comprises:

selecting a first waveform version for generating a first portion of the audio waveform; and selecting a second waveform version for generating a second portion of the audio waveform, the selecting comprising determining a start location of the second waveform based on an end location of the first waveform.

4. The method of claim 2, further comprising resampling the selected at least one waveform version to generate the audio waveform at the playback frequency.

5. The method of claim 2, wherein determining the number of partial waveforms comprises determining a maximum number of partial waveforms for the playback frequency of the audio waveform.

6. The method of claim 1, wherein obtaining the first data indicative of the set of partial waveforms comprises:

sampling the audio waveform to generate a sampled waveform;

transforming the sampled waveform from a time domain to a frequency domain to generate a frequency domain sampled waveform; and determining, based on the frequency domain sampled waveform, the set of partial waveforms for the audio waveform.

7. The method of claim 1, wherein determining the associated number of partials for each note comprises:

determining a supported sampling rate; and determining the associated number of partials for each note by dividing the supported sampling rate by a frequency of the note.

8. A system for generating an audio waveform at a playback frequency, the system comprising:

a processor in communication with a memory, wherein the memory is configured to store machine readable instructions that, when executed by the processor, cause the processor to:

obtain first data indicative of a set of partial waveforms of an audio waveform; and generate a wave table for the audio waveform based on the set of partial waveforms, comprising:

determine a set of notes, wherein each note has a corresponding entry in the wave table;

for each note in the set of notes:

determine an associated number of partials for the note;

render an associated waveform version of the audio waveform comprising the determined associated number of partials for the note from the set of partial waveforms; and store, in the corresponding entry of the note in the wave table, the associated waveform version.

9. The system of claim 8, wherein the instructions are further configured to cause the processor to:

determine a number of partial waveforms based on a sample rate, a playback frequency of the audio waveform, or both; and select, based on the first data and the number of partial waveforms, from the wave table, at least one waveform version of the audio waveform to generate the audio waveform at the playback frequency, wherein each waveform version stored in the wave table comprises a different number of partial waveforms for the audio waveform.

10. The system of claim 9, wherein selecting the at least one waveform version comprises:

selecting a first waveform version for generating a first portion of the audio waveform; and selecting a second waveform version for generating a second portion of the new audio waveform, wherein the selecting comprises determining a start location of the second waveform based on an end location of the first waveform.

11. The system of claim 9, wherein the instructions are further configured to cause the processor to resample the selected at least one waveform version to generate the audio waveform at the playback frequency.

12. The system of claim 9, wherein determining the number of partial waveforms comprises determining a maximum number of partial waveforms for the playback frequency of the audio waveform.

13. The system of claim 8, wherein obtaining the first data indicative of the set of partial waveforms comprises:

sampling the audio waveform to generate a sampled waveform;

transforming the sampled waveform from a time domain to a frequency domain to generate a frequency domain sampled waveform; and determining, based on the frequency domain sampled waveform, the set of partial waveforms for the audio waveform.

14. The system of claim 8, wherein determining the associated number of partials for each note comprises:

determining a supported sampling rate; and determining the associated number of partials for each note by dividing the supported sampling rate by a frequency of the note.

15. At least one computer readable storage medium storing processor-executable instructions that, when executed by at least one processor, cause the at least one processor to:

obtain first data indicative of a set of partial waveforms of an audio waveform; and generate a wave table for the audio waveform based on the set of partial waveforms, comprising:

determine a set of notes, wherein each note has a corresponding entry in the wave table;

for each note in the set of notes:

determine an associated number of partials for the note;

render an associated waveform version of the audio waveform comprising the determined associated number of partials for the note from the set of partial waveforms; and store, in the corresponding entry of the note in the wave table, the associated waveform version.

16. The at least one computer readable storage medium of claim 15, wherein the instructions are further configured to cause the processor to:

determine a number of partial waveforms based on a sample rate, a playback frequency of the audio waveform, or both; and select, based on the first data and the number of partial waveforms, from the wave table, at least one waveform version of the audio waveform to generate the audio waveform at the playback frequency, wherein each waveform version stored in the wave table comprises a different number of partial waveforms for the audio waveform.

17. The at least one computer readable storage medium of claim 16, wherein selecting the waveform version comprises:

selecting a first waveform version for generating a first portion of the audio waveform; and selecting a second waveform version for generating a second portion of the new audio waveform, wherein the selecting comprises determining a start location of the second waveform based on an end location of the first waveform.

18. The at least one computer readable storage medium of claim 16, wherein the instructions are further configured to cause the processor to resample the selected at least one waveform version to generate the new audio waveform at the playback frequency.

19. The at least one computer readable storage medium of claim 16, wherein determining the number of partial waveforms comprises determining a maximum number of partial waveforms for the playback frequency of the audio waveform.

20. The at least one computer readable storage medium of claim 15, wherein obtaining the first data indicative of the set of partial waveforms comprises:

sampling the audio waveform to generate a sampled waveform;

transforming the sampled waveform from a time domain to a frequency domain to generate a frequency domain sampled waveform; and determining, based on the frequency domain sampled waveform, the set of partial waveforms for the audio waveform.

* * * * *